US011220851B2

(12) United States Patent
Conner, II et al.

(10) Patent No.: US 11,220,851 B2
(45) Date of Patent: Jan. 11, 2022

(54) HINGE LUBRICATION DEVICE

(71) Applicant: Hey 9, Inc., Kirtland, OH (US)

(72) Inventors: Larry W. Conner, II, Kirtland, OH (US); Paul R. Metcalfe, Solon, OH (US); Scott Urban, University Heights, OH (US)

(73) Assignee: Hey 9, Inc., Kirtland, OH (US)

( * ) Notice: Subject to any disclaimer, the term of this patent is extended or adjusted under 35 U.S.C. 154(b) by 157 days.

(21) Appl. No.: 16/292,884

(22) Filed: Mar. 5, 2019

(65) Prior Publication Data

US 2020/0284080 A1 Sep. 10, 2020

(51) Int. Cl.
*E05D 11/02* (2006.01)

(52) U.S. Cl.
CPC ..... *E05D 11/02* (2013.01); *E05Y 2900/132* (2013.01); *Y10T 16/5373* (2015.01)

(58) Field of Classification Search
CPC ..... E05D 11/02; E05D 11/0054; E05D 2011/0072; Y10T 16/533; Y10T 16/5335; Y10T 16/5373; E05Y 2900/132
USPC ..... 16/250, 251, 274
See application file for complete search history.

(56) References Cited

U.S. PATENT DOCUMENTS

| | | | | |
|---|---|---|---|---|
| 3,422,486 | A * | 1/1969 | Henry, Jr. | E05D 5/043 16/251 |
| 4,570,291 | A * | 2/1986 | Smith | E05D 11/0054 16/250 |
| 4,802,259 | A * | 2/1989 | Geslewitz | E05D 11/0054 16/251 |
| 5,198,031 | A * | 3/1993 | Derstine | B05B 12/20 118/505 |
| 5,224,240 | A * | 7/1993 | Smith | E05D 11/0054 16/251 |
| 6,735,821 | B1 * | 5/2004 | Christman, Jr. | E05D 11/0054 16/250 |
| 7,703,577 | B1 * | 4/2010 | Zach | E05D 11/02 184/6.19 |
| 10,603,682 | B1 * | 3/2020 | Zalucki | E05D 11/00 |
| 2015/0285435 | A1 * | 10/2015 | Alghamdi | E05D 11/02 16/386 |
| 2019/0003226 | A1 * | 1/2019 | Alghamdi | F16N 7/02 |
| 2020/0078810 | A1 * | 3/2020 | Zalucki | E05D 11/00 |

* cited by examiner

*Primary Examiner* — William L Miller
(74) *Attorney, Agent, or Firm* — Calfee, Halter & Griswold LLP

(57) ABSTRACT

A device for lubricating a hinge includes a housing, a first elongated opening, a lubrication opening, a lubrication collection chamber, and an absorption element. The first elongated opening allows the housing to be placed over a portion of a hinge. The lubrication opening is for receiving a lubrication straw. The lubrication collection chamber is located at a bottom of the housing, and the absorption element is located within the lubrication collection chamber.

19 Claims, 12 Drawing Sheets

HINGE LUBRICATION DEVICE

TECHNICAL FIELD

The present invention relates generally to devices for lubricating a hinge, such as a hinge for a door.

BACKGROUND

Typical hinges for a door include a first side plate that is fixed to a door (e.g., by one or more fasteners), a second side plate that is fixed to a wall that is adjacent to the door (e.g., by one or more fasteners, and a pin. The first side plate has one or more knuckles for connecting the first side plate to the pin such that the first side plate can pivot about the pin, and the second side plate has one or more knuckles for connecting the second side plate. The one or more knuckles are hollow tubes that fit over a shaft of the pin, and the pin has a top tip and a bottom tip fork keeping the knuckles on the shaft of the pin.

As a door is moved between the open and closed positions, the knuckles of the side plates engage with each other and with the pin, which creates a frictional force between the components. If this frictional force becomes too high, the engagement between the knuckles and the pin causes a squeaking noise when the door is moved between the open and closed positions. In addition, the friction between the components often results in small-particle swarf or grim accumulating on the hinge assembly.

This squeaking noise can be prevented by lubricating the door hinge with a lubricant (e.g., WD-40®, PB Blaster®, silicone spray, silicone grease, etc.) that reduces the friction between the various components of the hinge. Lubricant can be applied to a hinge by disassembling the hinge and applying lubricant to the component parts prior to reassembly, spraying the lubricant on the hinge without first taking it apart and then wiping the excess lubricant with a towel, or applying the lubricant to an applicator (e.g., a fabric material, towel, a brush, a sponge, etc.) and wiping the hinge with the applicator. Lubricant can also be applied to a device that is subsequently attached to a hinge, and the lubricant moves from the device to the hinge by a capillary action.

SUMMARY

An exemplary embodiment of a device for lubricating a hinge includes a housing have a first portion and a second portion that is in fluid communication with the first portion. The housing also has a hinge opening and a lubricant opening, in which the hinge opening is configured to receive a hinge such that the hinge is disposed within the first portion of the housing. The second portion is configured to receive an absorption element. When a hinge is disposed within the first portion of the housing and absorption element is disposed within the second portion of the housing, the absorption element is disposed below the hinge such that lubricant applied through the lubricant opening moves through the first portion of the housing and into the second portion of the housing to be absorbed by the absorption element.

Another exemplary embodiment of a device for lubricating a hinge includes a housing, a first elongated opening, a lubrication opening, a lubrication collection chamber, and an absorption element. The first elongated opening allows the housing to be placed over a portion of a hinge. The lubrication opening is for receiving a lubrication straw. The lubrication collection chamber is located at a bottom of the housing, and the absorption element is located within the lubrication collection chamber.

An exemplary method of lubricating a hinge includes placing a lubrication device over a hinge. The lubrication device includes a housing and an absorption element disposed within the housing. The housing includes a lubricant opening and a hinge opening, in which the lubrication device is placed over a hinge by moving the hinge through the hinge opening such that the hinge is disposed within the housing and above the absorption element. The method further includes applying lubricant to the hinge through the lubricant opening.

DETAILED DESCRIPTION

Figure 1:
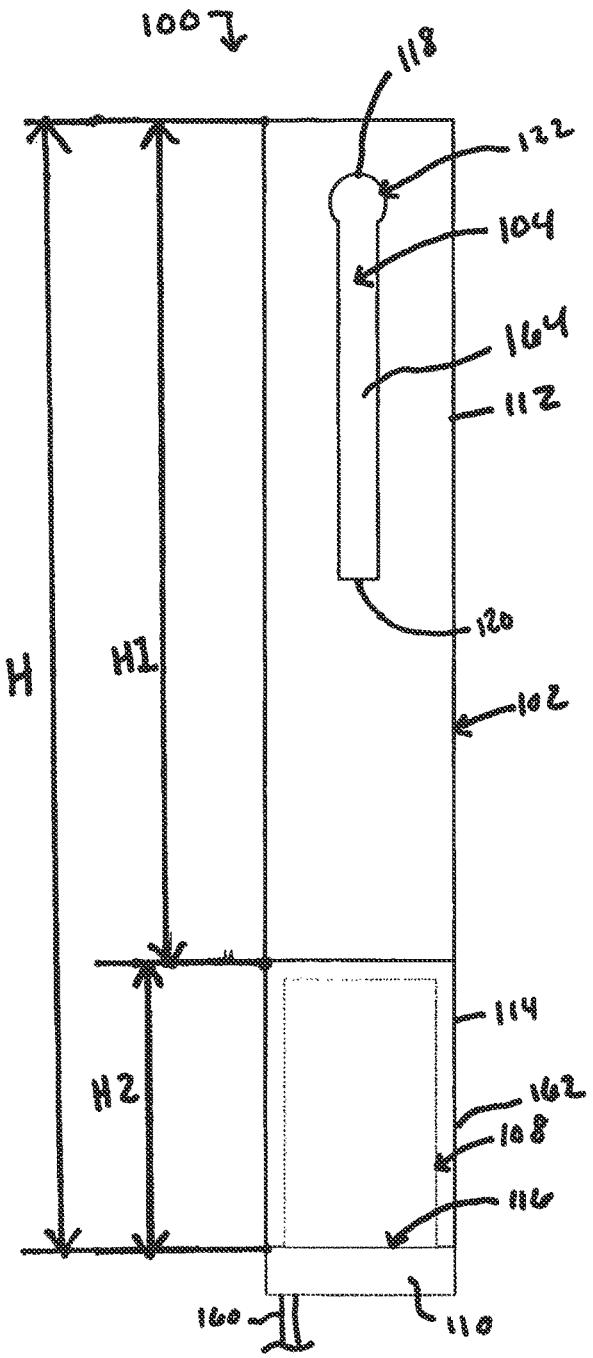
FIG. 1 is a front schematic view of an exemplary embodiment of a hinge lubrication device.

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

Hinges are often lubricated by applying a lubricant to the hinge by a spray device, or by applying the lubricant to an applicator (e.g., a fabric material, a towel, a brush, a sponge, etc.) and wiping the hinge down with the applicator. If a user is applying a spray lubricant directly to the hinge, a sufficient amount of lubricant needs to be sprayed onto the hinge in order for the lubricant to properly lubricate the hinge's inner portions, which can lead to lubricant being applied to a wall or door that is adjacent to the hinge, or can lead to the lubricant falling onto the floor. Lubricant being applied to the adjacent wall or door is problematic because the lubricant can lead to difficulties with paint adhesion in the future, and lubricant falling onto the floor is problematic because the lubricant can cause a slipping hazard. In addition, the resultant overspray on the wall, door, and/or floor necessitates a time-consuming and frustrating clean-up process. The pressurized spray can also cause any swarf (e.g., grindings from the hinge, dirt, or a combination thereof) that has accumulated on the hinge to be sprayed onto the wall or floor, which can cause staining or streaking that is difficult to clean. Alternatively, the hinge can be taken apart, and the lubricant can be sprayed directly onto the inner portions of the hinge, which can be time consuming. If a user is applying lubricant to a fabric material and wiping the lubricant directly to the hinge, the hinge needs to be taken apart in order for the user to apply the lubricant to the inner portions of the hinge, which is also time consuming. In addition, the hinge needs to be reassembled after the act of lubricating, thus adding even more time to the act of lubricating the hinge. If the inner portions of the hinge are not properly lubricated, the door may continue to squeak, or squeaking may return within a short period of time.

The exemplary hinge lubrication devices described herein are configured to be placed over a hinge, such that a spray lubricant (e.g., WD-40®, PB Blaster®, silicone spray, etc.) can be applied to the hinge without the lubricant falling onto the floor or being sprayed onto a wall or door that abuts the hinge, without hinge swarf falling onto the floor or being sprayed onto the wall or door, and without taking the hinge apart. The hinge lubrication devices described herein also allow for a user to directly apply the lubricant to the hinge using an external force (e.g., a force caused by pressurized air or other applied pushing force) to cause the liquid to move into narrow spaces of the hinge, rather than the lubricant moving into the narrow spaces of a hinge by a capillary action. It is advantageous for a user to be able to use an external force to cause the liquid to move into the narrow spaces of a hinge to ensure that the lubricant reaches the various narrow spaces of the hinge.

The hinge lubrication devices described herein have a housing that is placed over the hinge such that the hinge is at least partially surrounded by the housing, and the housing has a lubrication opening for receiving lubrication. The hinge lubrication devices also have an absorption element that is disposed within the housing and below the hinge when the device is attached to the hinge, and the absorption element collects and absorbs the lubrication that is placed into the housing during lubrication of the hinge. The various embodiments of the hinge lubrication devices described herein are advantageous because a sufficient amount of lubrication can be applied to the hinge that allows the inner portions of the hinge to be properly lubricated without lubricant being applied to an adjacent wall or door, and without lubricant falling onto the floor. That is, the housing of the devices described herein prevents the lubricant from being applied to an adjacent wall or door, and prevents the lubricant from falling onto the floor, and the absorption element collects and absorbs the lubricant. After one or more hinges are properly lubricated, and the absorption element has absorbed a substantial amount of lubricant, the absorption element can be removed and replaced with another absorption element such that the device can continue to be used to lubricate hinges.

The general inventive concepts of the present application will now be described by referencing the following exemplary embodiments. The description with reference to the following exemplary embodiments is not intended to limit the scope of the claims in any way, and the terms used in the claims have their full ordinary meaning. In addition, any feature or combination of features from each of the embodiments can be used with features or combinations of features from other embodiments. In the embodiments discussed herein, the hinge lubrication devices are described for use with a hinge for a door. However, the hinge lubrication device of the present application can be used for any type of hinge that requires lubrication.

Figure 2:
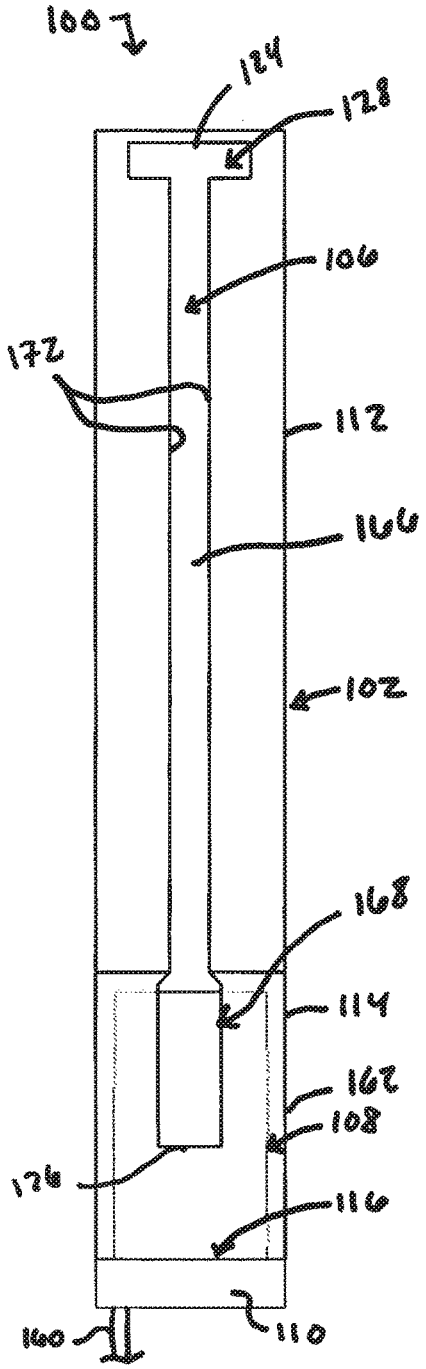
FIG. 2 is a rear schematic view of the hinge lubrication device of FIG. 1.
Figure 3:
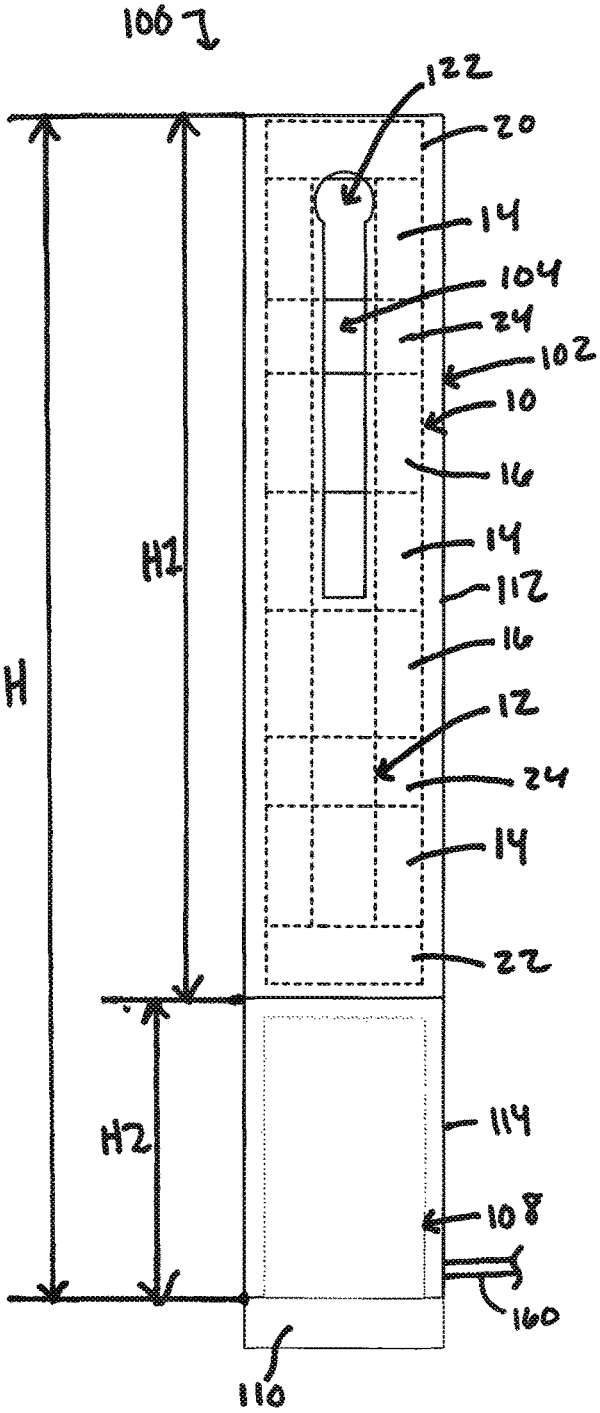
FIG. 3 is the front schematic view of the hinge lubrication device of FIG. 1, in which the hinge lubrication device is attached to a hinge.
Figure 4:
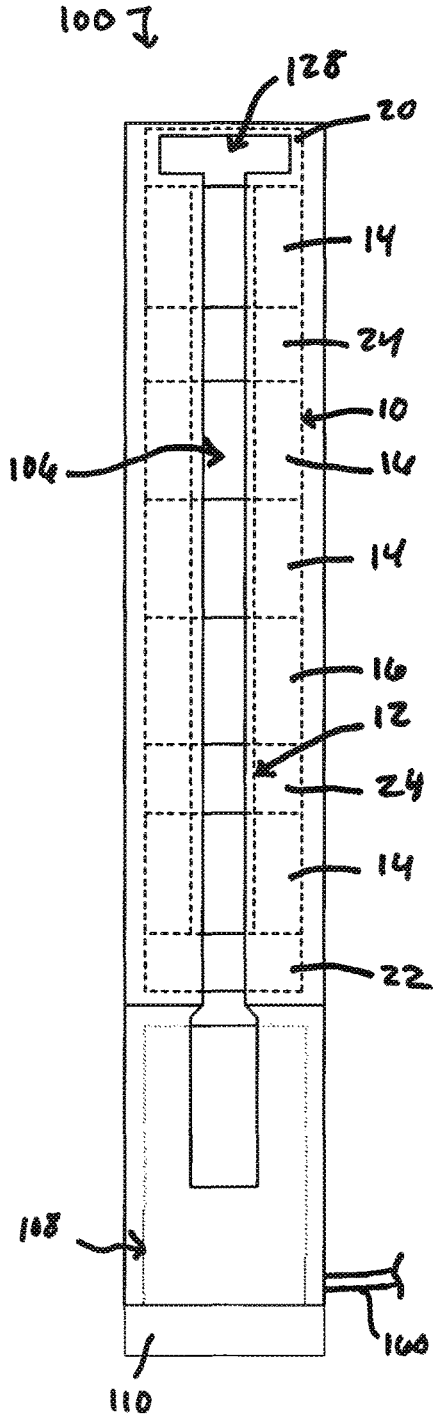
FIG. 4 is the rear schematic view of the hinge lubrication device of FIG. 1, in which the hinge lubrication device is attached to a hinge.
Figure 5:
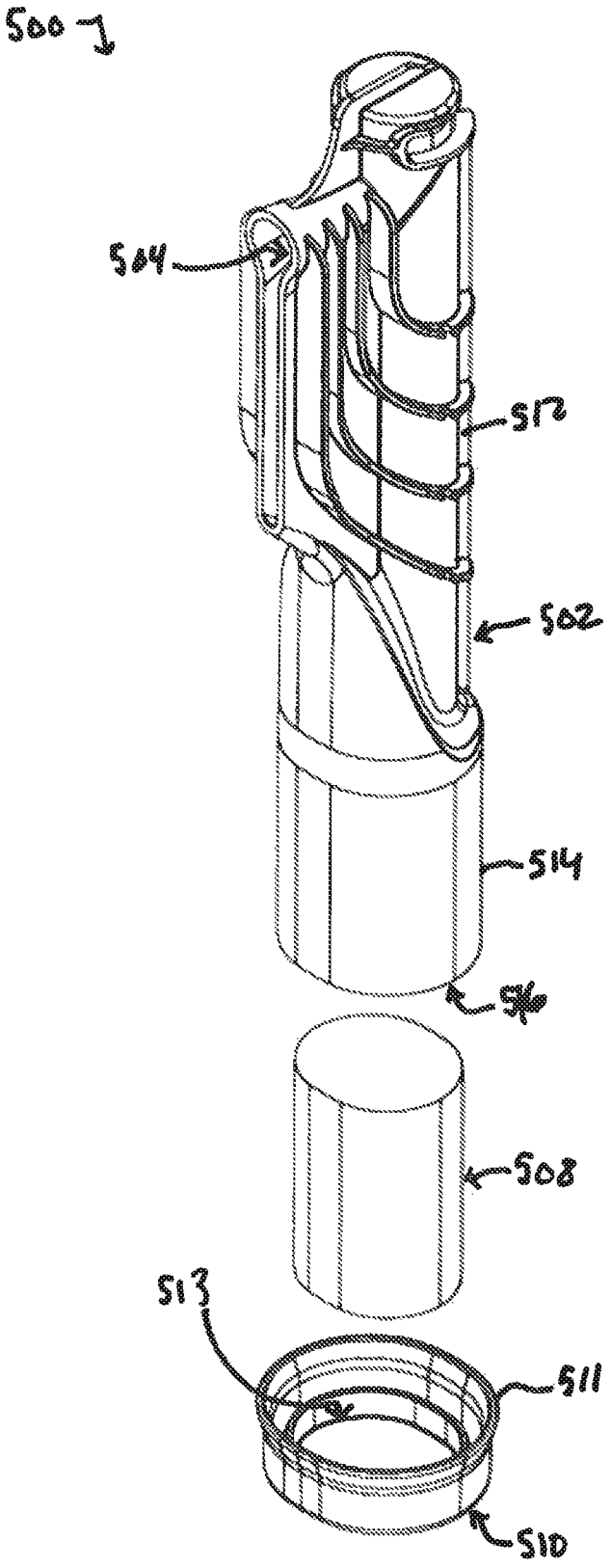
FIG. 5 is an exploded view of second exemplary embodiment of a hinge lubrication device.
Figure 6:
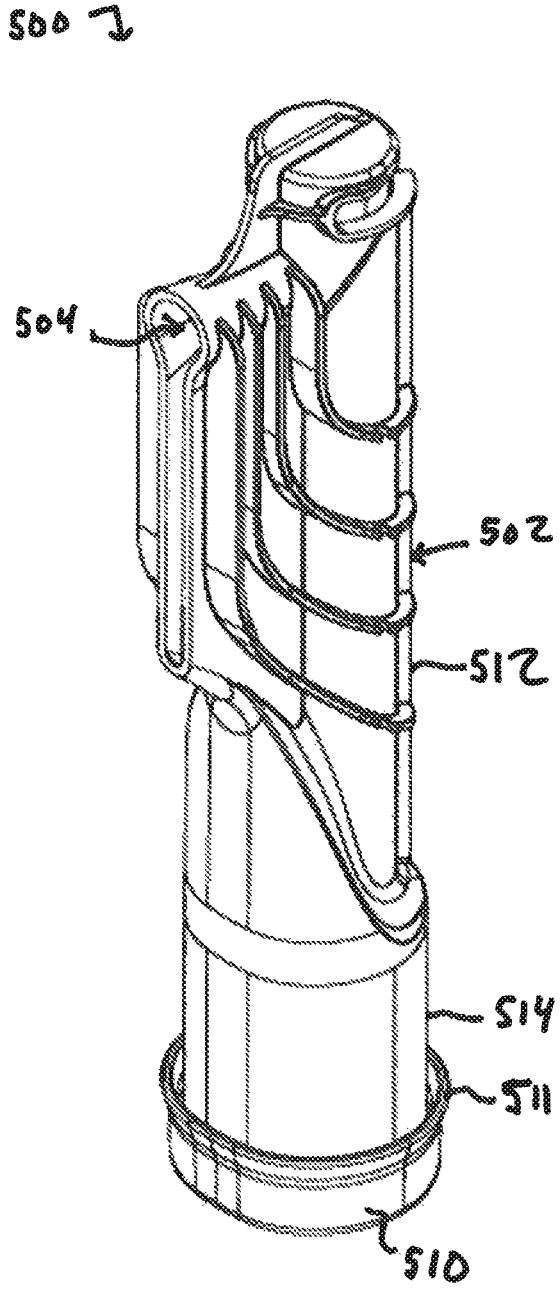
FIG. 6 is a front perspective view of the hinge lubrication device of FIG. 5.

Referring to FIGS. 1 through 4, an exemplary embodiment of a device 100 that is used for lubricating a hinge 10 (FIGS. 3 and 4) includes a housing 102, a lubrication opening 104, a hinge opening 106, and an absorption element 108. FIGS. 1 and 2 show the device 100 without a hinge being disposed within the device, and FIGS. 3 and 4 show the device with a hinge 10 disposed within the device. Referring to FIGS. 3 and 4, in certain embodiments, a hinge 10 has a first side plate (not shown) attached to a door, a second side plate (not shown) attached to a wall, and a pin 12. The first side plate has one or more first knuckles 14 for attaching the first side plate to the pin 12, and the second side plate has one or more second knuckles 16 for attaching the second side plate to the pin 12. The knuckles 14, 16 are hollow shafts that are placed over a shaft 18 of the pin 12, and the knuckles are maintained on the shaft by the top tip 20 and bottom tip 22 of the pin. The knuckles 14 of the first side plate (which is attached to the door that is being opened and closed) are configured to rotate about the pin to allow the door to move between opened and closed positions. In some embodiments, the hinge 10 has one or more bearings 24 for facilitating rotation of the knuckles 14 about the pin 12.

Referring to FIGS. 1-4, the housing 102 includes a first portion 112 sized for receiving a hinge 10 and a second portion 114 sized for holding the absorption element 108. The housing 102 has a height H, in which the first portion has a height H1 and the second portion has a height H2. These heights (H, H1, H2) can be a wide variety of different sizes. The first portion 112 is in fluid communication with the second portion 114, and the second portion acts as an lubrication collection chamber for collecting excess lubricant that is applied to a hinge in the first portion 112 of the housing 102. In certain embodiments, the second portion has an opening 116 such that the absorption element 108 can be removed and replaced with another absorption element. In the illustrated embodiment, the opening 116 is located at the bottom of the housing second portion 114 of the housing. In other embodiments, the opening 116 can be located in a side wall 162 of the housing 102. The first and second portions 112, 114 describe areas of the housing 102, and it should be understood that the first and second portions 112, 114 can be areas of a single part, or can be areas of separate parts that are configured to attach to each other to create the housing 102. In various embodiments, the housing 102 is made of a flexible material, such as, for example, silicone, natural rubber, urethane or other plastics, or any other type of suitable flexible material. In some embodiments, a portion of the housing can be made from a rigid material and another portion of the housing can be made from a flexible material. For example, the portion of the housing 102 having one or more of the openings 104, 106 can be made of flexible material, while other portions of the housing 102 can be made of a flexible material or a rigid material.

In the illustrated embodiment, the device 100 includes a cap 110 that is configured to attach to the second portion 114 of the housing 102 such that the opening 116 for receiving the absorption element is covered to maintain the absorption element 108 in the housing 102. The cap 110 can attach to the housing by any suitable type of connection, such as, for example, a friction fit connection, a snap fit connection, a hook and loop connection, or any other suitable type of connection. The cap 110 can be made of, for example, plastic, metal, hard rubber, wood, glass, or any other type of suitable material. In embodiments in which the opening 116 is located on the side wall 162 of the housing, or in which the housing does not have an opening 116 for removing and replacing the absorption element 108, the device 100 may not have a cap 110.

The absorption element 108 is configured to collect and absorb lubricant that is placed into the housing 102 of the device 100 during lubrication of the hinge 10. The absorption element 108 can take any suitable form that is capable of being disposed within the second portion 114 of the housing 102, such as, for example, a sheet of material that is rolled into a cylindrical shape, a material that is formed into a cylindrical shape, a material that is rolled or formed into any other shape that corresponds to the shape of the second portion 114 of the housing 102, or any other suitable shape. Alternatively, the absorption element 108 can include granular material that is inserted into the interior volume of the second portion 114 such that the granular materials take the shape of the second portion to trap and absorb any excess lubricant. The absorption element 108 can be made of any material that is capable of absorbing lubricant, such as, for example, cotton, sponges, chemical compounds, sand, cellulose, cat litter, clay absorbents, etc.

The lubrication opening 104 is configured to receive a straw of an aerosol lubricant spray container such that the aerosol lubricant spray container can be used to apply lubricant to a hinge. The lubrication opening 104 has a top end 118 and a bottom end 120, and the opening 104 extends from the top end to the bottom end along the height H of the housing 102. In the illustrated embodiment, the opening 104 is only disposed on the first portion 112 of the housing 102. In other embodiments, the top end 118 of the opening 104 be disposed on the first portion 112, and the bottom end 120 of the opening can be disposed on the second portion 114 such that the opening extends from the first portion 112 to the second portion 114.

In certain embodiments, the opening 104 includes an elongated slot 164 and a wider opening 122 that has a width that is greater than the width of the other portions of the opening 104. In certain embodiments, the wider opening 122 is sized for receiving a door stop (not shown) that is attached to a hinge assembly. The wider opening 122 can also allow a user to insert a straw or nozzle of an aerosol lubricant spray container, a valve of the aerosol lubricant spray container to which the straw or nozzle is attached, or a straw, nozzle, or valve of another type of lubrication device into the wider opening 122 such that the lubrication device can provide lubrication to the hinge 10. Once the spray container is in the wider opening 122 of the opening, the spray container can be moved to any point along the opening 104 because of the flexible material of the housing 102, which allows a user to provide lubrication to multiple locations of the hinge 10. In the illustrated embodiment, wider opening 122 is located at the top 118 of the opening 104. The wider opening 122 can, however, be located at any portion of the opening 104 that corresponds to the location of a door stop for a hinge assembly.

The hinge opening 106 is configured to receive a hinge such that the hinge is disposed within the housing 102 of the device 100. The hinge opening 106 has a top end 124, a bottom end 126, and sides 172. The opening 106 extends from the top end to the bottom end along the height of the housing 102. In the illustrated embodiment, the top end 124 of the opening 106 is disposed on the first portion 112, and the bottom end 126 of the opening can be disposed on the second portion 114 such that the opening 106 extends from the first portion 112 to the second portion 114. It is advantageous to have the opening 106 extend into the second portion 114 so that a user can examine the absorption element through the opening 106 to determine whether the absorption element 108 needs to be removed and replaced. In various embodiments, the bottom of the opening 106 includes a wider opening 168 that helps the opening 106 to flex when receiving a hinge 10, or helps the opening 106 to flex for a user to remove the absorption element 108 from the housing 102 (e.g., if the housing does not have an opening 116 for removing the absorption element). In certain embodiments, the opening 106 includes an elongated slot 166 and a wider opening 128 proximate the top of the opening 106 that has a width that is greater than the width of the other portions of the opening. The wider opening 128 may be shaped to correspond to the top tip 20 of the pin 12, or may be shaped such that the opening 106 can flex to receive a hinge 10.

Referring to FIGS. 3 and 4, an exemplary method of lubricating a hinge 10 includes placing the hinge lubrication device 100 onto the hinge 10. The hinge lubrication device 100 is placed onto the hinge 10 by aligning the hinge opening 106 with the hinge and providing a force to the device such that the hinge enters the housing 102. In some embodiments, the wider opening 128 of the hinge opening 106 is aligned with the top tip 20 of the hinge 10 prior to forcing the device onto the hinge. In the illustrated embodiment, the hinge opening 106 is smaller than the hinge 10 such that a force needs to be provided to the device 100 to cause the material of the housing 102 to flex and allow the hinge to move through the opening 106. It is advantageous to have a portion of the opening 106 extend into the second portion 114 of the housing 102 to facilitate flexing of the opening 106 when the hinge 10 is being placed into the device 100. After the hinge 10 is in the housing 102 of the device 100, the flexible material of the housing 102 moves back to its normal position such that the housing prevents the hinge from moving back through the opening 106 without a force from a user. The sides 172 of the opening 106 may be configured to enclose the hinge to prevent lubricant overspray from leaving the device 100 during lubrication of the hinge. In other embodiments, the opening 106 is larger than the hinge 10, and the device 100 remains on the hinge 10 by the gravitational force provided on the device.

After the hinge lubrication device 100 is placed on the hinge 10, the method includes providing lubricant into the housing 102 through the lubrication opening 104. The lubrication can be provided to various locations of the hinge such that the lubricant can move between the various parts (e.g., the knuckles 14, 16, the bearings 24, the shaft 12, the top tip 20, the bottom tip 22) of the hinge 10. Excess lubricant will move downward through the housing 102 until it is collected and absorbed by the absorption element 108.

In certain embodiments, the hinge lubrication device 100 includes a hose or tube 160 that is in fluid communication with the housing 102 such that excess lubricant can move from the housing, through the tube 160, and into a separate receptacle (not shown) from the housing. This allows a user to collect the excess lubricant such that the excess lubricant can be re-used, to collect lubricant in volumes large than the second portion 114 of the housing 102 was designed to accommodate, and to lubricate many hinges without needing to replace the absorption element 108 or empty the collected lubricant from the housing 102. Referring to FIGS. 1 and 2, in some embodiments, the tube 160 can be attached to the cap 110. Referring to FIGS. 3 and 4, in other embodiments, the tube 160 can be attached to the second portion 114 of the housing 100.

After the hinge 10 is sufficiently lubricated, the hinge lubrication device 100 is removed by providing a pulling force to the device such that the hinge 10 moves through the hinge opening 106 of the device. The sides 172 of the hinge opening 106 may be configured to wipe excess lubricant off of the hinge as they are pulled across the hinge during the removal process. That is, the sides 172 can act as a squeegee device that wipes excess lubricant from the hinge when the device 100 is removed from the hinge. After the device 100 is removed from the hinge 10, the user can determine whether the absorption element needs to be replaced. If the absorption element 108 does not need to be replaced, the user can use the hinge lubrication device to lubricate another hinge. If the absorption element needs to be replaced, the user can remove the cap 110 from the housing 102, remove the absorption element 108, and replace the absorption element with a new absorption element prior to lubricating another hinge.

Referring to FIGS. 5-11, another exemplary embodiment of a hinge lubrication device 500 for lubricating a hinge (e.g., hinge 10 in FIGS. 3 and 4) is shown (which is a more specific embodiment of the hinge lubrication device shown in FIGS. 1-4). The hinge lubrication device 500 includes a housing 502, a lubrication opening 504, a hinge opening 806 (FIG. 8), an absorption element 508, and a cap 510. The housing 502 includes a first portion 512 that is sized for holding a hinge and a second portion 514 that is sized for holding the absorption element 508. The first portion 512 is in fluid communication with the second portion 514, and the second portion 514 acts as a lubrication collection chamber for collecting excess lubricant that is applied to a hinge in the first portion 512 of the housing 502. The second portion has an opening 516 such that the absorption element 508 can be removed and replaced with another absorption element. In the illustrated embodiment, the first and second portions 512, 514 are a single part. In other embodiments, the first and second portions 512, 514 can be separate parts that are configured to attach to each other to create the housing 502. In various embodiments, the housing 502 is made of a flexible material, such as, for example, silicone, natural rubber, urethane or other plastics, or any other type of suitable flexible material. In some embodiments, a portion of the housing can be made from a rigid material and another portion of the housing can be made from a flexible material. For example, the portion(s) of the housing 502 having one or more of the openings 504, 806 can be made of flexible material, while other portions of the housing 502 can be made of a flexible material or a rigid material.

The cap 510 is configured to attach to the second portion 514 of the housing 502 such that the opening 516 for receiving the absorption element 508 is covered to maintain the absorption element in the housing 502. In the illustrated embodiment, the cap 510 attaches to the housing 502 by a friction fit connection. That is, the second portion 514 of the housing 502 is wider than the cap 510 such that housing flexes to fit within the cap, and the cap is maintained on the housing by the force of the housing trying to move back to its normal position. In certain embodiment, the cap 510 includes an edge 511 that is wider than the second portion 514 of the housing 502, but the width of the cap gradually decreases from the edge 511 until width of the cap is less than the width of the second portion of the housing. This facilitates flexing of the housing 502 such that the cap 510 can extend over and attach to the housing. In various embodiments, the cap 510 includes a receiving portion 513 for receiving the absorption element 508. In these embodiments, the absorption element 508 can be placed in the receiving portion 513 of the cap 510, and the cap 510 can be attached to the housing 502, such that the absorption element is disposed in the second portion 514 of the housing. The cap 510 can be made of, for example, plastic, metal, hard rubber, wood, glass, or any other type of suitable material.

The absorption element 508 is configured to collect and absorb lubricant that is placed into the housing 502 of the device 500 during lubrication of the hinge. The absorption element 508 can take any suitable form that is capable of being disposed within the second portion 514 of the housing 502, such as, for example, a sheet of material that is rolled into a cylindrical shape, a material that is formed into a cylindrical shape, a material that is rolled or formed into any other shape that corresponds to the shape of the second portion 514 of the housing 502, or any other suitable shape. Alternatively, the absorption element 508 can include granular material that is inserted into the interior volume of the second portion 514 such that the granular materials take the shape of the second portion to trap and absorb any excess lubricant. The absorption element 508 can be made of any material that is capable of absorbing lubricant, such as, for example, cotton, sponges, chemical compounds, sand, cellulose, cat litter, clay absorbents, etc.

Figure 7:
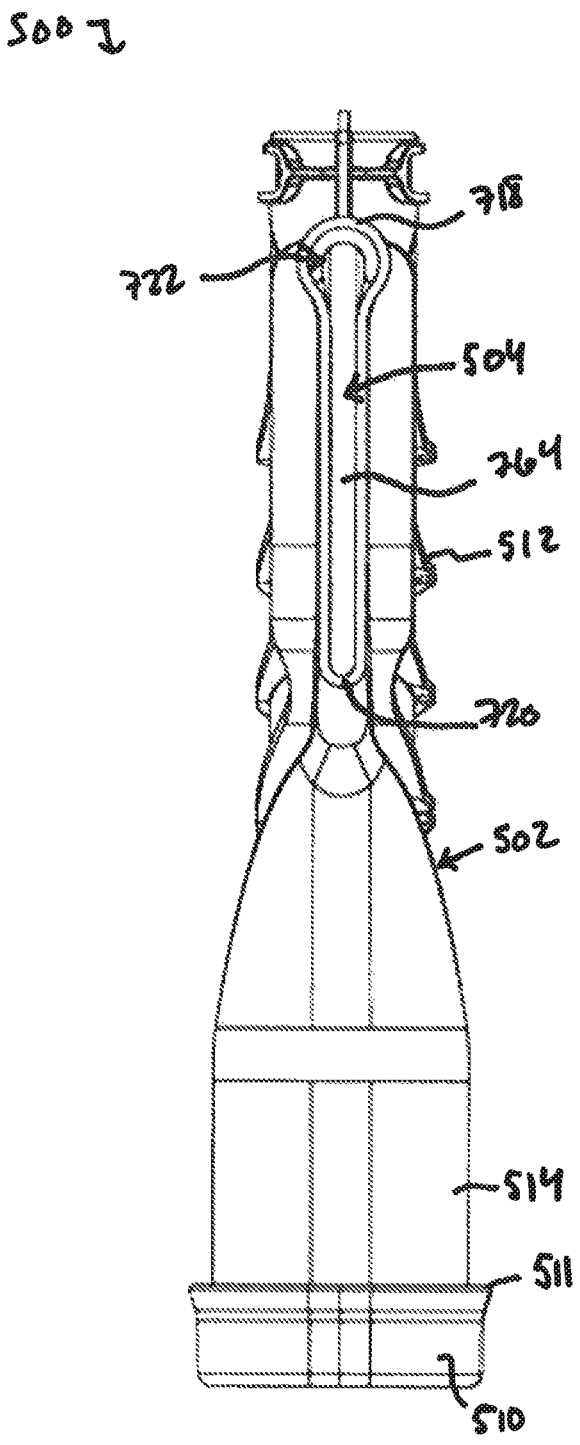
FIG. 7 is a front view of the hinge lubrication device of FIG. 5.
Figure 8:
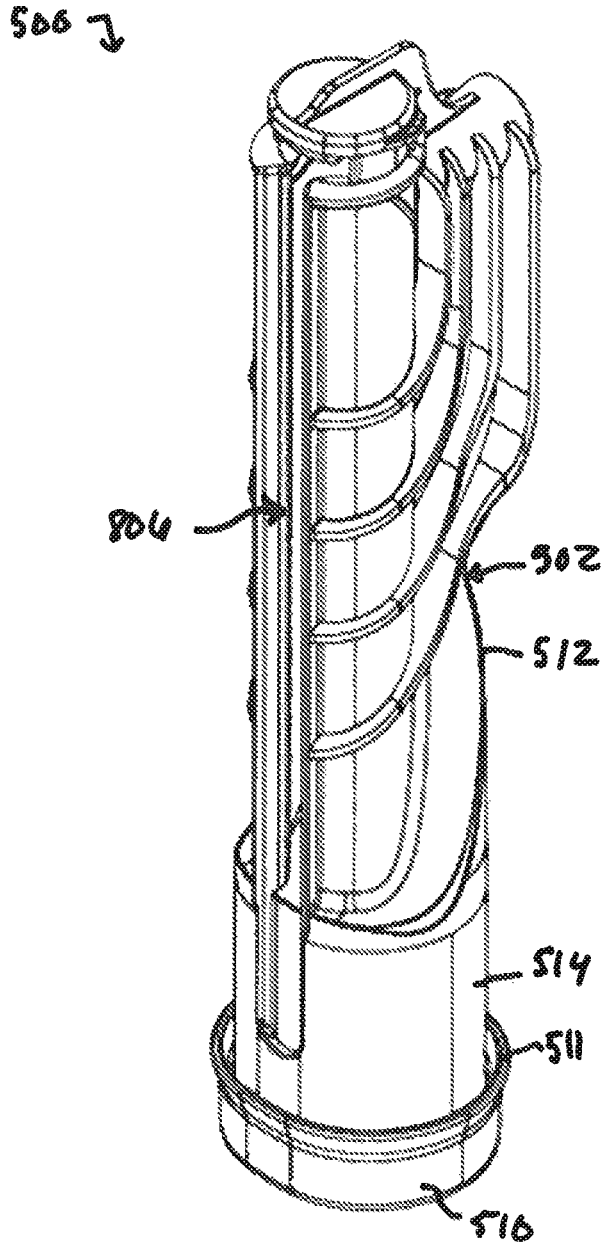
FIG. 8 is a rear perspective view of the hinge lubrication device of FIG. 5.

Referring to FIG. 7, the lubrication opening 504 is configured to receive a straw of an aerosol lubricant spray container such that the aerosol lubricant spray container can be used to apply lubricant to a hinge. The lubrication opening 504 has a top end 718 and a bottom end 720, and the opening 504 extends from the top end to the bottom end along the height of the housing 502. The opening 504 is disposed on the first portion 512 of the housing 502. In other embodiments, the top end 718 of the opening 504 be disposed on the first portion 512, and the bottom end 720 of the opening can be disposed on the second portion 514 such that the opening extends from the first portion 512 to the second portion 514.

In certain embodiments, the opening 504 includes an elongated slot 764 and a wider opening 722 that has a width that is greater than the width of the other portions of the opening 504. In certain embodiments, the wider opening 722 is sized for receiving a door stop (not shown) that is attached to a hinge assembly. In the illustrated embodiment, the wider opening 722 has a round shape. In other embodiments, the wider opening 722 can take any other suitable form that corresponds to the shape of a door stop of a hinge assembly, or any other suitable form that allows the wider opening 722 to receive a door stop of a hinge assembly. Once the nozzle of the lubrication device is in the wider opening 722 of the opening 504, the nozzle of the lubrication device can be moved to any point along the opening 504 because of the flexible material of the housing 502, which allows a user to provide lubrication to multiple locations of a hinge. In the illustrated embodiment, wider opening 722 is located at the top 718 of the opening 504. The wider opening 722 can, however, be located at any portion of the opening 504 that corresponds to the location of a stopper for a hinge assembly.

Figure 9:
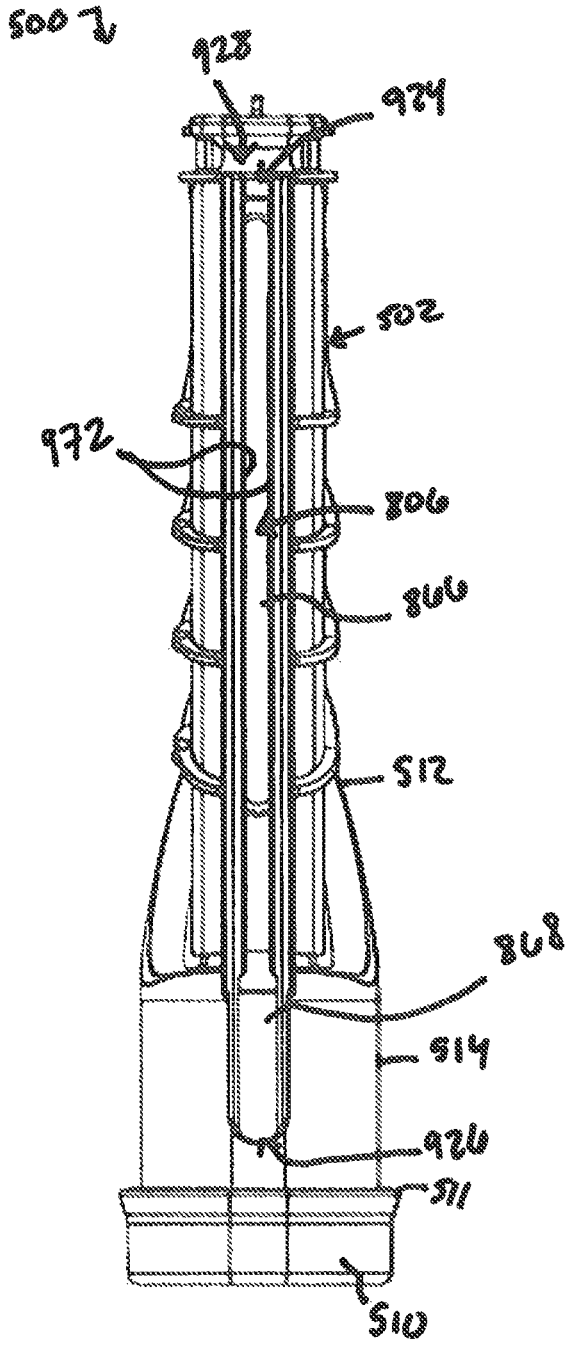
FIG. 9 is a rear view of the hinge lubrication device of FIG. 5.
Figure 10:
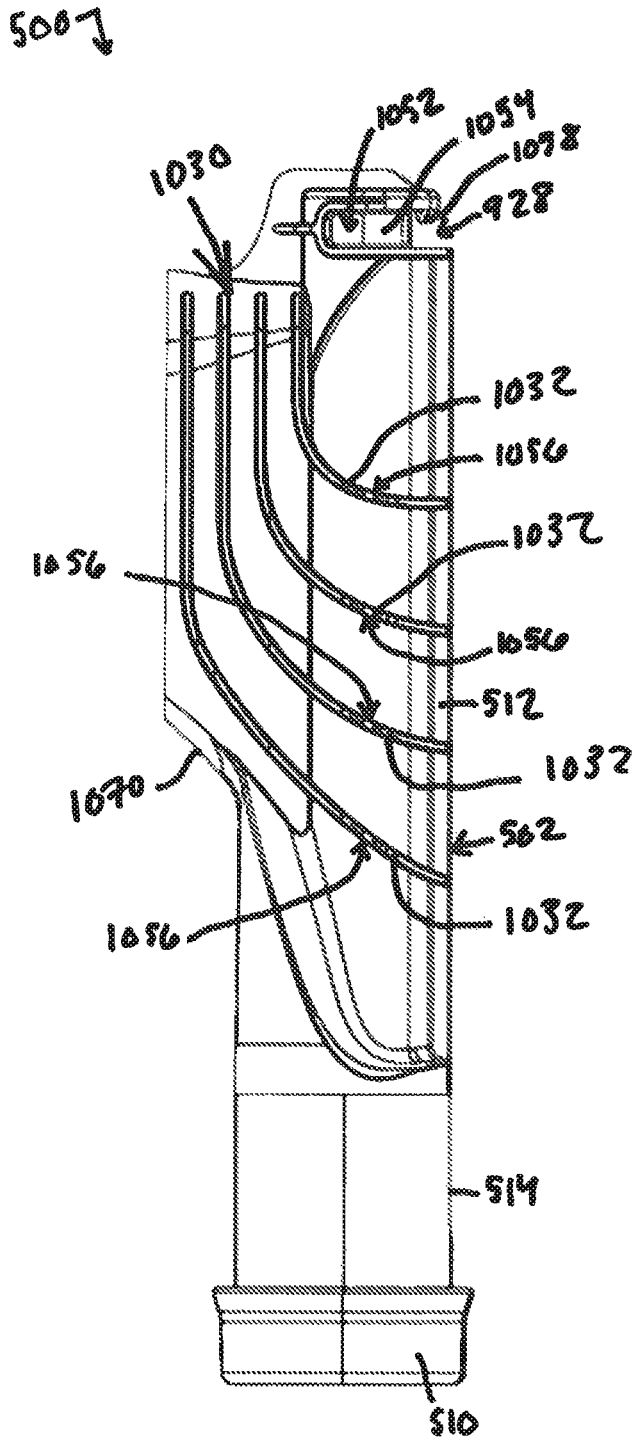
FIG. 10 is a right side view of the hinge lubrication device of FIG. 5.

Referring to FIG. 9, the hinge opening 806 is configured to receive a hinge such that the hinge is disposed within the housing 502 of the device 500. The hinge opening 806 has a top end 924, a bottom end 926, and sides 972. The opening 806 extends from the top end to the bottom end along the height of the housing 502. In the illustrated embodiment, the top end 924 of the opening 806 is disposed on the first portion 512, and the bottom end 926 of the opening is be disposed on the second portion 514 such that the opening 806 extends from the first portion 512 to the second portion 514. It is advantageous to have the opening 806 extend into the second portion 514 so that a user can examine the absorption element 508 to determine whether the absorption element 508 needs to be replaced. In the illustrated embodiment, the bottom of the opening 806 has a wider portion 868 that helps the opening 806 to flex when receiving a hinge, or helps the opening 806 to flex for a user to remove the absorption element 508 from the housing 502 (e.g., if the housing does not have an opening 116 for removing the absorption element). In certain embodiments, the opening 806 includes an elongated slot 866 and a wider opening 928 proximate the top of the opening 806 that has a width that is greater than the width of the other portions of the opening. The wider opening 928 may be shaped to correspond to the shape of the top tip of a pin of a hinge, or may be shaped such that the opening 806 can flex to receive a hinge. Referring to FIGS. 9 and 10, in various embodiments, the housing 502 includes a lip 1058 (FIG. 10) that extends into the top end 924 of the opening 806 to prevent a hinge from moving out of the hinge lubrication device 500 through the opening 806 during use of the hinge lubrication device. The lip 1058 also helps contain any spray lubricant directed upwardly during use of the hinge lubrication device from exiting through the opening 806. The sides 972 of the opening 806 may be configured to enclose the hinge to prevent lubricant overspray from leaving the device 100 during lubrication of the hinge, and may be configured to wipe excess lubricant off of the hinge as the sides 972 are pulled across the hinge during the removal process of the device 100.

Referring to FIG. 10, in certain embodiments, the first portion 512 of the housing 502 has a door stop opening 1052 for receiving door stops that are attached to the hinge. In certain embodiments, the first portion 512 includes one or more curtains 1054 that extends over the door stop opening 1052. When the hinge lubrication device 500 is attached to a hinge having a door stop, the curtain 1054 encloses a door stop within the door stop opening 1052 to prevent lubricant from being sprayed out of the door stop opening and onto the door. In certain embodiments, one side of each of the one or more curtains is attached to the first portion 512 of the housing 502 such that, when the curtain is engaged by a door stop, the curtain pivots relative to the housing to allow the door stop to enter door stop opening 1052. After the door stop enters the door stop opening 1052, the one or more curtains pivots back toward its normal position to enclose the door stop within the door stop opening 1052. The one or more curtains 1054 are made of a flexible material, such as, for example, silicone, natural rubber, urethane or other plastics, etc.

Still referring to FIG. 10, in certain embodiments, the housing 502 of the hinge lubrication device 500 includes an extended member 1030 that extends from the first portion 512 of the housing. The extended member 1030 provides a user with a gripping area for placement and removal of the device 500. In the illustrated embodiment, the extended member 1030 includes one or more grippers 1032 to help a user grip the device 500. The grippers 1032 can take any suitable form that allow a user to better grip the device 500, such as, for example, one or more protrusions, ribs, bumps, ripples, studs, etc. In the illustrated embodiment, the grippers 1032 extend over both the first portion 512 of the housing 502 and the extended member 1030. In other embodiments, the grippers 1032 may only be disposed on the extended member, or the grippers may be disposed on any other portion of the housing 502 that allows a user to grip the device 500.

In certain embodiments, the lubricant opening 504 is disposed on the extended member 1030, and the extended member is in fluid communication with the interior of the first portion 512 of the housing 502. It is advantageous to have the lubricant opening 504 be disposed on the extended member 1030 because the hinge will be further away from the opening 504 (as compared to a hinge lubrication device that does not have extended member 1030) during lubrication of a hinge, which can prevent lubricant from splashing back through the opening 504 after contacting the hinge.

Figure 11:
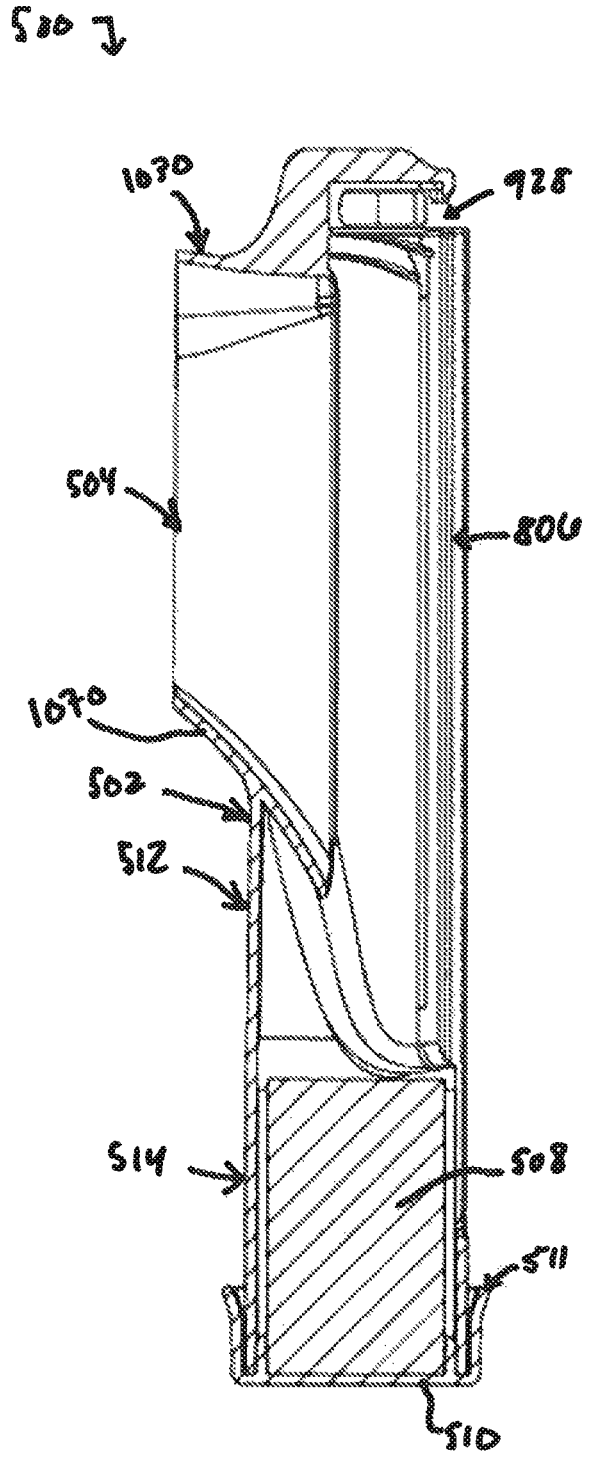
FIG. 11 is a cross-sectional side view of the hinge lubrication device of FIG. 5.

Referring to FIGS. 10 and 11, in certain embodiments, a bottom portion of the extended member 1030 includes a downward slope 1070. The downward slope 1070 allows a user to angle a straw of an aerosol lubricant spray container downward to better apply lubricant to a lower portion of a hinge. The downward slope 1070 also causes any excess lubricant in the extended member 1030 to move from the extended member and into the second portion 514 of the housing such that the lubricant can be absorbed by the absorption element 508.

Referring to FIG. 10, in certain embodiments, the housing 502 includes one or more straw holders for holding an extra straw (not shown) that is used with an aerosol lubricant spray container. This allows a user to replace the original straw of an aerosol lubricant spray container if the original straw is lost or damaged, or if a user desires a new straw. In the illustrated embodiment, the straw holder includes various aligned channels 1056 of the one or more grippers 1032, which are aligned such that a portion of the extra straw is attached to one or more of the various aligned channels. The channels 1056 are sized such that a straw can be inserted into the channels and remain in the channels. For example, the straw can remain in the channels 1056 by a friction fit connection, a snap fit connection, or any other suitable connection that allows the straw to be easily inserted into and removed from the channels. In the illustrated embodiment, each of the grippers 1032 include a single channel 1056 for receiving a single straw. In other embodiments, each of the grippers 1032 can include more than one channel 1056 such that more than one straw can be attached to the housing 502. While the straw holder of the illustrated embodiment is shown on the grippers 1032, it should be understood that one or more straws can be attached to any other suitable location on the housing.

Figure 12:
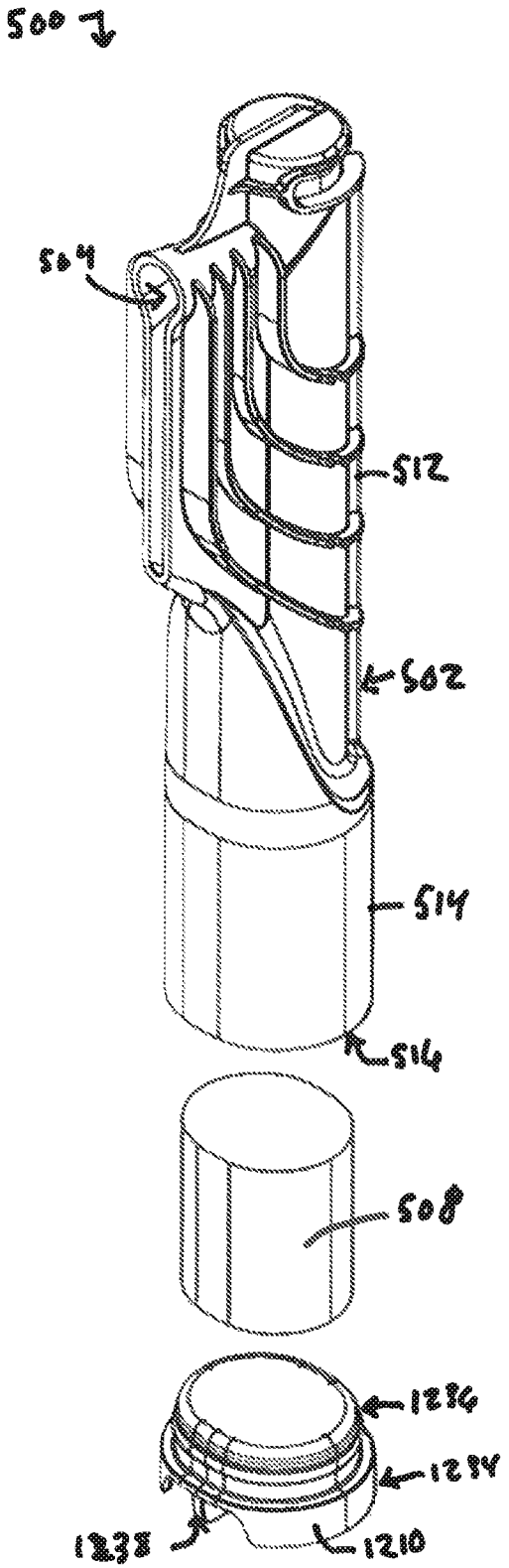
FIG. 12 is an exploded view of the hinge lubrication device of FIG. 5, in which hinge lubrication device includes a second exemplary embodiment of a cap.
Figure 13:
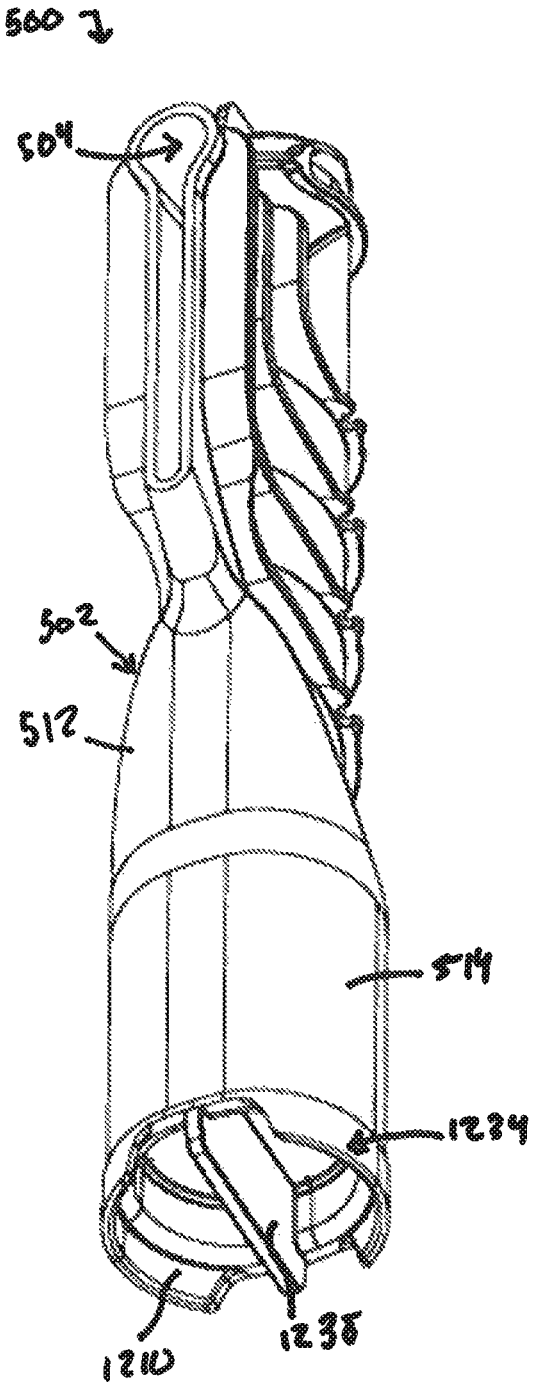
FIG. 13 is a perspective view of the hinge lubrication device of FIG. 5 with the cap of FIG. 12.
Figure 14:
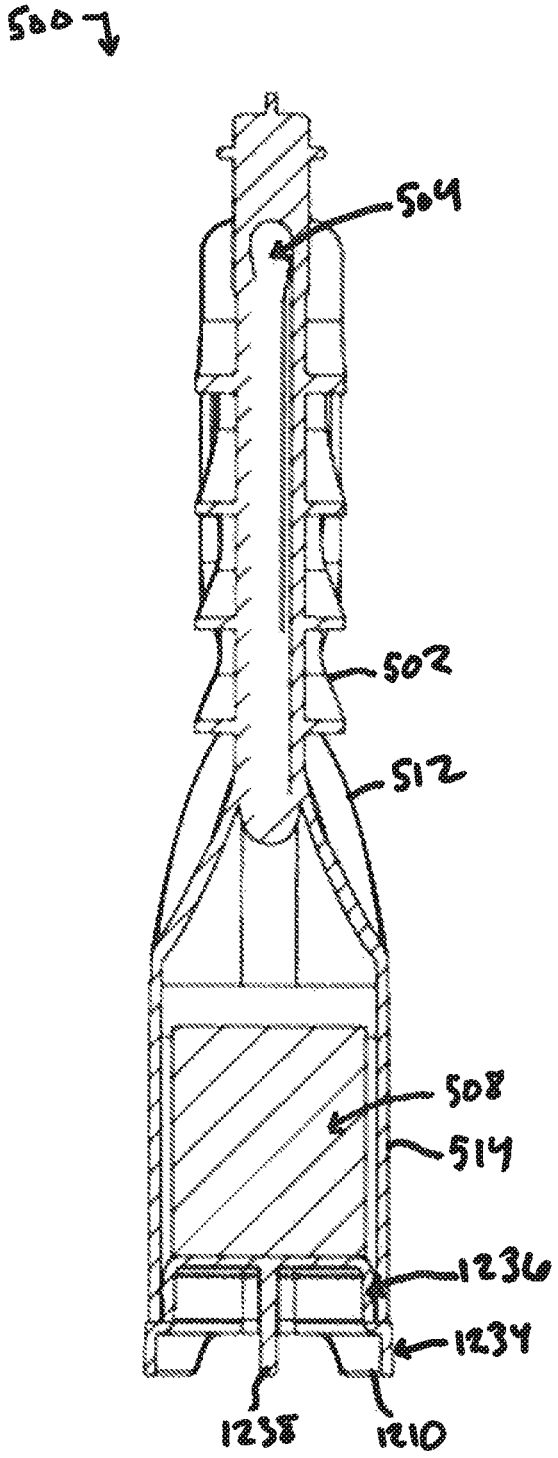
FIG. 14 is a cross-sectional front view of the hinge lubrication device of FIG. 5 with the cap of FIG. 12.

Referring to FIGS. 12-14, another exemplary embodiment of a cap 1210 that can be used for the hinge lubrication device 500 (FIGS. 5-11). The cap 1210 is configured to attach to the second portion 514 of the housing 502 such that the opening 516 for receiving the absorption element 508 is covered to maintain the absorption element in the housing 502. In the illustrated embodiment, the cap 1210 includes a first portion 1234 and a second portion 1236, in which the first portion 1234 is held by a user such that the user can attach and detach the cap from the housing 502, and in which the second portion 1236 is configured to engage the interior of the second portion 514 of the housing 502 to connect the cap to the housing. That is, the second portion 1236 of the cap 1210 is wider than the interior of the housing 502 such that a user can push the second portion 1236 of the cap into the housing 502, which causes the housing to flex outward, and the cap is maintained on the housing by the force of the housing trying to move back to its normal position. In certain embodiments, the first portion 1234 of the cap 1210 includes a protrusion 1238 for a user to engage to attach or detach the cap to the housing 502. The cap 1210 can be made of, for example, plastic, metal, hard rubber, wood, glass, or any other suitable material.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A device for lubricating a hinge comprises:

a housing having a first portion and a second portion that is in fluid communication with the first portion, wherein the housing comprises a hinge opening and a lubricant opening, wherein the hinge opening is configured to receive a hinge such that the hinge is disposed within the first portion of the housing, wherein the second portion comprises an open area; and wherein, when a hinge is disposed within the first portion of the housing, the second portion of the housing is located below the bottom of the hinge; and a removable absorption element disposed within the second portion of the housing, wherein the removable absorption element is inserted into and removed from the second portion of the housing through a bottom opening of the housing.

2. The device according to claim 1, wherein at least a portion of the hinge opening is disposed on both the first portion of the housing and the second portion of the housing.

3. The device according to claim 1, wherein the first portion of the housing and the second portion of the housing are made from a single piece of material.

4. The device according to claim 1, wherein the housing is made from at least one of silicone, natural rubber, and urethane.

5. The device according to claim 1, wherein the housing includes one or more grippers.

6. The device according to claim 1, wherein the housing comprises at least one straw holder that includes one or more channels that are configured to receive a straw.

7. A housing having a first portion and a second portion that is in fluid communication with the first portion, wherein the housing comprises a hinge opening and a lubricant opening, wherein the hinge opening is configured to receive a hinge such that the hinge is disposed within the first portion of the housing, wherein the second portion comprises an open area; and wherein, when a hinge is disposed within the first portion of the housing, the second portion of the housing is located below the bottom of the hinge; and a removable cap that is movable between an open position and a closed position relative to the housing, wherein the removable cap is attached to the second portion of the housing such that the removable cap covers a bottom opening of the housing when the removable cap is in the closed position, and wherein the removable cap is detached from the housing when the removable cap is in the open position.

8. A hinge lubricating device comprising:

a housing;

a first elongated opening for allowing the housing to be placed over a portion of a hinge;

a lubrication opening for receiving a lubrication straw;

a lubrication collection chamber located at a bottom of the housing;

wherein the lubrication collection chamber is located below the bottom of a hinge, when the lubricating device is placed over a hinge; and an absorption element located within the lubrication collection chamber;

wherein the absorption element absorbs and retains excess lubricant.

9. The hinge lubricating device according to claim 8, further comprising an extended member that extends away from the housing, wherein the lubrication opening is an elongated opening that is located in the extended member.

10. The hinge lubricating device according to claim 9, wherein the lower portion of the extended member slopes downward.

11. The hinge lubricating device according to claim 9, wherein the extended member comprises a grip portion having one or more grippers.

12. The hinge lubricating device according to claim 8, wherein the lubrication collection chamber comprises an opening for removing and replacing the absorption element, and wherein the hinge lubrication device further comprises a cap for covering the opening of the lubrication collection chamber.

13. The hinge lubricating device according to claim 8, wherein the lubrication opening comprises an elongated slot and a wider opening relative to the elongated slot proximate a top of the elongated slot.

14. The hinge lubrication device according to claim 8, wherein the housing comprises a door stop opening for receiving a door stop when the hinge lubricating device is placed over a hinge.

15. The device according to claim 8, wherein one or more sides of the first elongated opening are configured to enclose the hinge to prevent lubricant overspray from leaving the device through the first elongated opening during lubrication of the hinge, and wherein the one or more sides of the first elongated opening are configured to wipe excess lubricant off of the hinge as the one or more sides move across the hinge during removal of the device from the hinge.

16. A method for lubricating a hinge:

placing a lubrication device over the hinge, wherein the lubrication device comprises a housing and an absorption element disposed within the housing, wherein the housing comprises a lubricant opening and a hinge opening, wherein the lubrication device is placed over the hinge by moving the hinge through the hinge opening of the housing such that the hinge is disposed within the housing and above the absorption element; and applying lubricant to the hinge through the lubricant opening of the housing.

17. The method according to claim 16, further comprising removing the absorption element from the housing and inserting a replacement absorption element into the housing after the absorption element is removed from the housing.

18. The method according to claim 16, wherein the housing further comprises a first portion and a second portion that is in fluid communication with the first portion, and wherein the hinge is disposed within the first portion when the lubrication device is placed over the hinge and the absorption element is disposed within the second portion.

19. The method according to claim 18, wherein at least a portion of the hinge opening is disposed on both the first portion and the second portion of the housing.

* * * * *